United States Patent [19]

Küpper

[11] Patent Number: 4,566,651

[45] Date of Patent: Jan. 28, 1986

[54] ASSEMBLY OF A SUPPORT AND THREAD TENSIONERS FOR A BOBBIN CREEL

[75] Inventor: Wilhelm Küpper, Wegberg, Fed. Rep. of Germany

[73] Assignee: W. Schlafhorst & Co., Monchen-Gladbach, Fed. Rep. of Germany

[21] Appl. No.: 518,366

[22] Filed: Jul. 29, 1983

[30] Foreign Application Priority Data

Jul. 29, 1982 [DE] Fed. Rep. of Germany ..... 3228282

[51] Int. Cl.[4] ..... B65H 59/22

[52] U.S. Cl. ..... 242/150 R; 242/131

[58] Field of Search ..... 242/150 R, 150 M, 149, 242/147 R, 131, 131.1

[56] References Cited

U.S. PATENT DOCUMENTS

| | | | |
|---|---|---|---|
| 3,297,264 | 1/1967 | Gilbos | 242/150 R X |
| 3,459,389 | 8/1969 | Wildi et al. | 242/150 R |
| 3,967,657 | 7/1976 | Cugini | 242/150 R X |
| 4,175,718 | 11/1979 | Derichs et al. | 242/150 R |
| 4,202,511 | 5/1980 | Koslowski | 242/150 R |
| 4,272,038 | 6/1981 | Wildi | 242/150 R |
| 4,398,681 | 8/1983 | Kupper | 242/150 R |

*Primary Examiner*—Stanley N. Gilreath

*Attorney, Agent, or Firm*—Herbert L. Lerner; Laurence A. Greenberg

[57] ABSTRACT

An assembly for a bobbin creel includes a rod-shaped support and thread tensioners connected to the support, the support being a rod with a hollow profile and formed with a longitudinal slot; each of the thread tensioners having a drive unit, a loading unit and at least one cup-type thread brake connected to the drive unit; the cup-type thread brake having a substantially horizontal axis of rotation; the drive units of the thread tensioners being disposed in the interior of the rod with the hollow profile; a common drive element connecting the drive units to one another; and a releasable clamping element connecting the cup-type thread brake to the support.

42 Claims, 7 Drawing Figures

ASSEMBLY OF A SUPPORT AND THREAD TENSIONERS FOR A BOBBIN CREEL

The invention relates to an assembly of a rod-shaped support and thread tensioners connected to the support for a bobbin creel.

In a bobbin creel, the supports of the thread tensioners are customarily combined to form a clamping frame. The bobbin creel may contain a multiplicity of such clamping frames. The clamping frames may be stationary or movable. The supports of the clamping frame, on which the thread tensioners are mounted, may be arranged horizontally or vertically.

The construction of heretoforeknown assemblies of this general type is not optimal because they do not permit undisturbed creel operation over extended periods of time. This has various causes. The thread tensioners get dirty too fast and therefore also wear out too fast; the thread brake becomes increasingly non-uniform and finally, the creel must be taken out of operation too soon to make cleaning or replacement work possible. If cup-type thread brakes are used, which is the rule, an increase of the cup diameter, which is desirable for some applications, is limited because the cup weight increases more than proportionally. Restarting the cleaned and overhauled creel is difficult because drawing in the threads is also cumbersome. Replacing worn parts is complicated, and resetting and sorting the thread withdrawal are very expensive.

It is an object of the invention to provide such an assembly having a compact construction which permits longer, undisturbed operation of the creel, avoiding the described drawbacks. Further objects are to provide such an assembly which reduces danger of contamination, provides for continuous automatic dirt removal and ensures that the thread brakes do not wear out too fast. A further object of the invention is to provide such an assembly wherein enlarging of the cup diameter does not lead to a heavier stress on the thread brake.

With the foregoing and other objects in view, there is provided, in accordance with the invention, an assembly for a bobbin creel comprising a rod-shaped support and thread tensioners connected to the support, the support being a rod with a hollow profile and formed with a longitudinal slot; each of the thread tensioners having a drive unit, a loading unit and at least one cup-type thread brake connected to the drive unit; the cup-type thread brake having a substantially horizontal axis of rotation; the drive units of the thread tensioners being disposed in the interior of the rod with the hollow profile; a common drive element connecting the drive units to one another; and a releasable clamping element connecting the cup-type thread brake to the support.

Before the invention is explained and described in detail hereinafter, special advantages and peculiarities of the invention will be discussed.

The support constructed as a hollow profile is usually vertical. Several supports are then connected by upper and lower cross-pieces to form a clamping frame. Each support, together with the thread tensioners, forms an assembly. In a creel, several thread tensioners, for example, eight thread tensioners disposed side by side or on top of each other, are connected together with a support to form an assembly. Each of these thread tensioners comprises a drive unit, a loading unit and at least one cup-type thread brake. One cup-type thread brake is sufficient if, for example, the central shaft of the cup-type thread brake is used as an additional cable friction brake or if, besides the cup-type thread brake, a separate cable friction brake is further provided which serves simultaneously for deflecting the thread. At least one cup of the cup-type thread brake is connected to the drive unit. If a second cup-type thread brake is provided, at least one cup can be driven also in the second cup-type thread brake, the cups of the second cup-type thread brake can also be driven by the traveling thread alone, and a separate external drive would then not have to be provided in the second cup-type thread brake. Whether this is permissible, with regard to achieving minimum wear and a thread tension which is as uniform as possible, depends among other things on the adjusted braking effect.

Because the axis of rotation of the cup-type thread brake is disposed horizontally or approximately horizontally, there is, in principle no longer any objection to increasing the cup diameter. At any rate, no appreciable additional forces can be exerted on the thread if the cup diameter is increased.

Because the drive units of the thread tensioners are arranged in the interior of the hollow-profile rod, precautionary measures are thus taken beforehand against operational disturbances due to collecting and winding-up of thread remainders, fly and dust. In addition, the support forms a protection against contact which, in turn, reduces the danger of accidents. The drive units are connected to each other by a common drive element. This drive element is advantageously guided alongside the support or in the interior of the support.

The cup-type thread brake is connected to the drive unit; simultaneously, to the support by a detachable or releasable clamping element. Therefore, the drive unit requires no separate tensioning element. Every thread tensioner, in all caes, also has a loading unit, the particulars of which are discussed hereinafter.

In the interest of compact construction of the creel, the cups of the cup-type thread brake are arranged so closely to the support that the thread is guided past the support in the immediate vicinity of the support. In normal creel operation, the thread should not touch the support, unless the support itself were constructed as a kind of cable friction brake. This, however, must be reserved for special cases.

The drive unit may advantageously have a gear box with crossing or intersecting axes. One of the two gears theeof can be viewed as belonging to the thread brake. For the gearing, spiral spur gears or miter gears, for example, may be used. Also crown gear transmissions may be used, for example. Toothing of the wheels is not absolutely necessary. Friction wheels can also be used. The drive wheel of the gear transmission advantageously has a hollow shaft containing the drive element. The drive wheel, on the other hand, is connected to a drive shaft of the cup-type thread brake.

The drive element, which is responsible for several thread tensioners, is advantageously formed of a rotatable rod which is driven at one end thereof. This rod may be of square or hexagonal and generally polygonal cross section. The hollow shaft of the drive wheel has a fitting inner profile which permits longitudinal displacement of the drive element and, simultaneously, a positively locked entrainment of the drive wheel. A given amount of play is provided between the hollow shaft of the drive wheel and the polygonal profile of the drive element. The drive element is thereby also given a given amount of lateral mobility, so that alignment and adjustment problems do not arise.

As a condition for further advantageous embodiments, the support, which is constructed as a hollow section or hollow profile rod, may have an angular C-shaped cross section. Such a cross section provides for the support two opposite edges which define the longitudinal slot and to which the thread tensioners can be clamped.

In a further embodiment of the invention, the drive unit has a support unit with forwardly-directed projections and/or depressions. These projections and/or depressions are advantageously disposed in the vicinity of the longitudinal slot of the support. Also, the cup-type thread brake is provided with a support body having rearwardly-directed projections and/or depressions, the projections and/or depressions being in engagement with each other in a positively locked and releasable manner. The two support bodies are thus to receive mutual lateral guidance by plugging them together. This facilitates the assembly work. Advantageously, the support body of the drive unit has, at the front side thereof, a recess wherein a holding latch for the support body of the cup-type thread brake is received, the latch, in turn, engaging from the inside with the two edges of the support. The holding latch thus belongs actually to the support body of the cup-type thread brake; it is supported by the support body of the drive unit only for purposes of assembly. So that the support body of the drive unit can be moved easily by hand during the assembly in the interior of the support but then can remain in the adjusted position thereof in a self-locking manner, the support body of the drive unit advantageously then has a spring element which is braced against the support. This spring element may be formed, for example, of a leaf spring. Accordingly, the support body of the drive unit is braced in the forward direction by the holding latch and, in the rearward direction, by the spring element. Within the support, the support body of the drive unit therefore always has a given amount of forward and rearward mobility even if the thread tensioner is later formly clamped to the support.

The support body of the cup-type thread brake advantageously rests on the support on the outside and is clamped by the hereinafore-mentioned releasable clamping element to the support body of the drive unit and/or to the support. Thus, the clamping element can either press the two support bodies against the support, or only the holding latch is pressed against the support body of the cup-type thread brake from the front. In the latter case, the mobility of the support body of the drive unit is preserved. The clamping element is to permit fast clamping or releasing of the parts without problems. For this purpose, for example, a screw, as well as wedge connections, snap connections and other fast-acting clamping connections are conceivably suitable. To permit clamping with only one clamping element, the support body of the cup-type thread brake has feet at one end thereof, the feet engaging behind the two edges defining the longitudinal slot.

In the construction of the assembly, it can be assumed that the support body of the drive unit can always be of such dimensions that it fits through the longitudinal slot of the support. However, because the support is customarily closed at both end thereof because it is mounted in a frame, the possibility generally does not exist of bringing the feet of the support body of the cup-type thread brake behind the edges defining the longitudinal slot. For this reason, it is proposed that the support has at least one cutout at the edge defining the longitudinal slot, which permits insertion of the feet of the support body. In the assembly, the feet of all of the thread tensioners belonging to the support are successively pushed through this slot. After the feet are inserted, the support bodies of the cup-type thread brakes already have some support. Thus, for example, they do not slide downwardly together but remain suspended at a convenient height at the support before the assembly is completed.

Advantageously, the support body of the cup-type thread brake has, on at least one side thereof, at least one thread-guiding element. This may be a thread-guiding element which is effective only for threading. However, it may also be a thread-guiding element which influences the course of the thread continuously and accordingly serves as a cable friction brake.

Such thread-guiding elements also should be as easy to assemble as possible. It is therefore proposed that the thread-guiding element have projections and/or depressions directed towards the support body, and that the support body also has projections and/or depressions directed towards the thread-guiding elements. The projections and/or depressions engage each other mutually in a form-locking or positive-locking and releasable manner. This involves a connector clamp which either already holds the connected parts together or initially only facilitates the assembly. For the last-mentioned case, it is proposed that the part of the thread-guiding element provided with projections and/or depressions be located between the support body and the support, and the thread-guiding element be secured in the position thereof by the clamping of the support body. Only by the clamping of the support body is accidental or intended detachment or release of the thread-guiding elements from the support body rendered impossible.

The loading unit of the thread tensioner can be held separately and fastened, for example to the support. It is proposed that it have a pneumatic loading device for at least one of the two cups, which can be subjected to a pressure deviating from atmospheric pressure and can be adjusted centrally for a number of cup-type thread brakes. The advantage is especially in the central control of the thread tension for the entire creel.

Advantageously, the pneumatic loading device has a chamber which contains an elastic container of variable volume connected to a central compressed-gas supply device, the elastic container acting upon mechanical transmission means which effect the loading of at least one of the two cups. The aforementioned chamber may be located, for example, in the support body of the cup-type thread brake.

So that no braking force deviations due to the porosity of the mateial, due to leaky connections or due to varying material thickness of the elastic container may occur, it is further proposed that the elastic container be formed of plastic foils, the edges of which are welded together, and that a flexible plastic hose communicating with or terminating in the interior of the elastic container, be welded or cemented to the elastic container. From this, there results also the advantage that, in mass production of cup-type thread brakes, exactly predictable braking forces can be achieved without adjusitng efforts and without sorting-out rejects. In addition, the advantages of elastic lines for connecting the individual cup-type thread brakes to a central compressed-gas supply device are fully utilized, without detrimental vibrations, such as can occur in rough creel operation, being transmitted to the elastic container. The plastic hose may have, for example, at the end thereof a disc-like enlargement which is connected on the inside to the elastic container. Such a unit formed of an elastic container and a hose can be exchanged very easily as a whole in case of damage.

It may happen that during operation, the desired thread braking forces are not obtained in the creel because each thread brake has its own braking capacity due to material tolerances, arrangement tolerances and conditions of the pneumatic system, which deviates from the braking capacity of the adjacent thread brake. These deviations may in some circumstances be very small but can be noticed as interfering.

In long creels, ordinary pneumatic loading devices do not provide the possibility of adjustng the braking action of the front thread brakes differently from the braking action of the rear thread brakes if a pressure adjustment from a central location is desired and provided.

To make the assemblies suitable for actually attaining, during operation, the desired thread braking forces and for varying those forces proportionally by a central pressure change of the pneumatic system, it is additionally proposed that the loading unit have, besides the pneumatic loadind device, a mechanical loading device cooperating with the pneumatic loading device. In the initial or original assembly, the adjustment is performed once at the mechanical loading device. Otherwise, the load is changed by the pneumatic system alone.

Advantageously, the force of the pneumatic loading device acts in the same direction as the force of the mechanical loading system. This has the advantage that even if no pressure prevails in the pneumatic system or if the pneumatic system fails, a mechanical pre-tension is always present. However, cases are also conceivable wherein it is better if the force of the pneumatic loading system is directed against or counter to the force of the mechanical loading device. In this case, the pneumatic loading device becomes effective only if the force of the mechanical loading device is overcome.

The mechanical loading system may have, for example, a spring, the spring force of which can be adjusted by an adjusting screw. The force can be transmitted via a lever-like loading element to the outer cup of the cup-type thread brake. This loading element may be formed, for example, of a two-arm lever which is pivoted on the support body of the cup-type thread brake. The pivot, for the purpose of easier assembly and disassembly, may be formed of a hinge which can be suspended and removed.

So that the load on the cup does not become one-sided, an easily exchangeable "load hood" can be inserted for better force distribution between the cup and the loading element. The hood is loaded at the center and its rim rests on the cup.

For vertical supports, the loading unit will advantageously be arranged below the cup-type thread brake. This has advantages with respect to threading. The thread can then be inserted into the thread brake from above without impediment.

It is advantageous to make the support body of the drive unit so narrow that space is provided adjacent to it in the interior for power supply lines and/or control lines. The hollow profile of the support provides good protection for such lines. The lines also need not be fastened separately in the support. Such power supply lines include, for example, the lines of the pneumatic system.

The creel generally has very many assemblies according to the invention. The drive elements of the assemblies can, of course, be driven centrally. However, it may also be of advantage if, for example, each support is connected to an individual driving device for the drive element of its drive units. Such an individual drive device may be formed, for example, of an electric reduction-gear motor or a stepping motor. With individual drives, different speeds can be adjusted.

For the purpose of providing optimal or beter thread guidance when threading-in, the cup towards the rear may have a dish-like rim which protrudes into a depression of the support body of the cup-type thread brake. The support body itself can be tapered upwardly towards the support for the same purpose. A tensioned or also tensionless thread can therefore slide along the support first, then slide over the support body and, over the dish-shaped rim of the rear cup, can slip finally under tension into the gap between the two cups. Also, the hereinaforementioned thread-guide element can have at least one guiding edge directed away from the support towards the thread brake for guiding the thread while it is being threaded in.

Prior to the threading, it may occur that individual threads will be rather far removed from the supports. So that this does not cause thread breaks or thread damage, it is proposed that the loading element be bent-away at the ends thereof towards the support for the purpose of diverting the thread during threading. If this is the case, a thread cannot get under the loading element or the pivot of the loading element very easily. Likewise for the purpose of diverting the thread, the outer cup may also have a dish-shaped rim, behind which one bent-away end of the loading element dips into the cup, while the other bent-away end of the loading element extends around the edge of the support body of the cup-type thread brake for the purpose of fixing the position with play. The end extending around the edge of the support body is therefore at the bottom as a rule. If the loading element is once suspended in its hinge, the bent-away lower end prevents accidental unintended loosening or releasing of the loading element.

For installing the assembly, no tools are required at all with the exception of a possibly necessary tightening key for tightening the tightening element which clamps the thread tensioner to the support. In a loading device which is integrated in the support element of the cup-type thread brake, it is therefore advisable to ensure that the parts thereof are likewise replaceable in a relatively easy manner. It is therefore proposed that the chamber of the pneumatic loading device and, optionally, a further chamber wherein the mechanical loading device is received, be closed off at the front by a detachable lid wherein opeanings are provided which permit contact between the loading device and the loading element. This lid prevents dust from penetrating and protects the elastic container against damage. If the lid contains a snap-in connection it can be opened entirely without tools. A simple plug connection or a simple screw connection can also be used.

It is believed to be apparent from the previous explanations that threads can be inserted easily, that constant uniform braking can be achieved which in addition can be controlled centrally, that dirt particles cannot stick to the cups and drop down; that cups of any size can be used; and that the overall assembly is of compact construction. Many parts are protected by the support, and the thread tensioners can be adjusted quite simply continously i.e. not stepwise, to a desired height above the floor. The lines of the pneumatic system are not in the way.

Other features which are considered as characteristic for the invention are set forth in the appended claims.

Although the invention is illustrated and described herein as embodied in an assembly of a support and thread tensioners for a bobbin creel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embosiments when read in connection with the accompanying drawings, in which.

Figure 1:
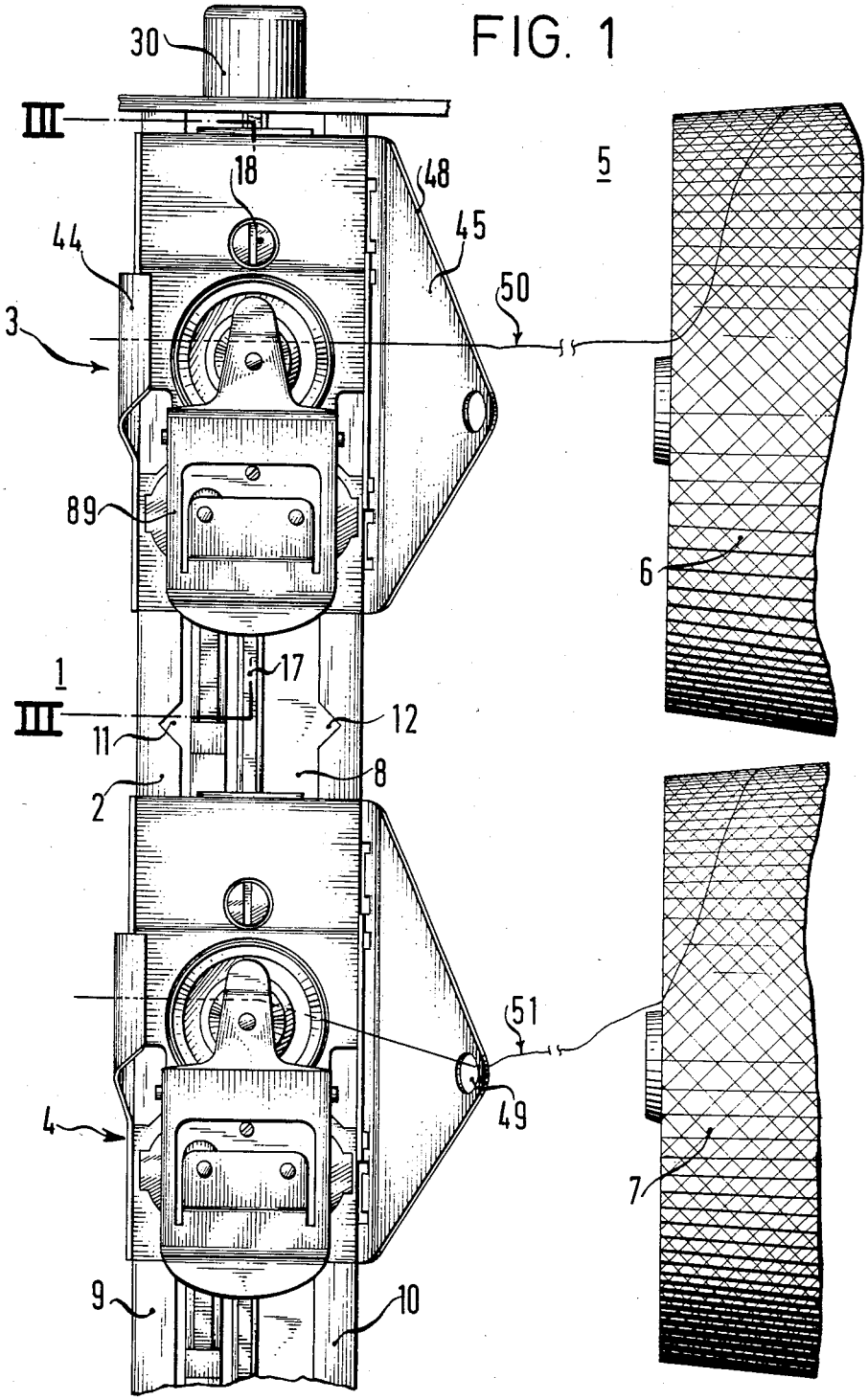
FIG. 1 is a fragmentary front elevational view of the assembly according to the invention.

Referring now to the drawing and first, particularly, to FIG. 1 thereof, there is shown an assembly, identified as a whole by reference numeral 1, which is formed of a rod-shaped support 2 and of thread tensioners 3 and 4 connected to the support 2. The assembly is part of a non-illustrated rack of a bobbin creel of which only one bobbin plane 5 with bobbins 6 and 7 is visible in FIG. 1. The support 2 is constructed as a hollow-section rod provided with a longitudinal slot 8, and specifically as a rod with an angular C-shaped profile. The support 2 is formed with edges 9 and 10 which define the longitudinal slot. At the same height above the floor, the edges 9 is formed with a cutout 11 and the edge 10 with a cutout 12. The two thread tensioners 3 and 4 are of identical construction.

Figure 2:
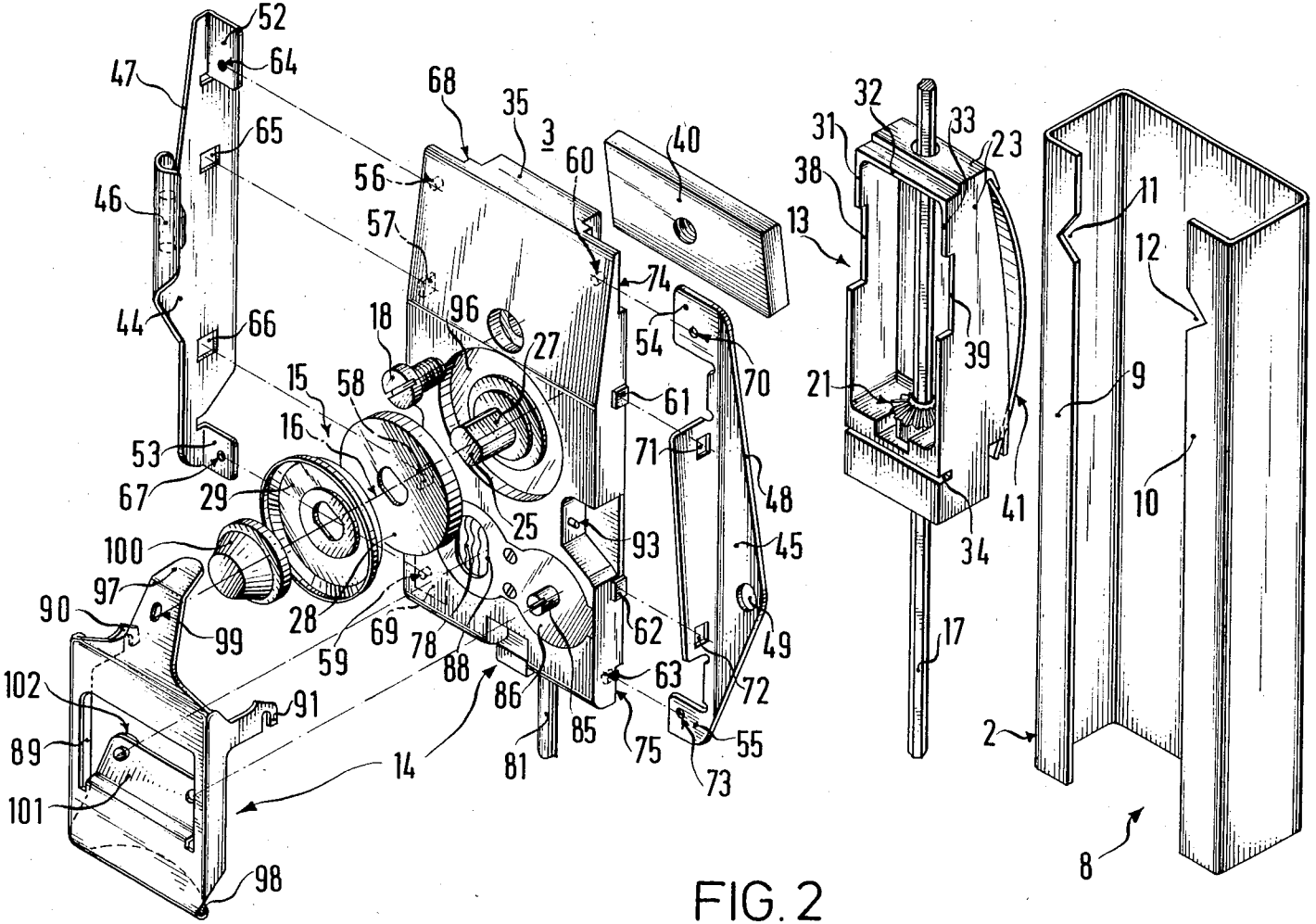
FIG. 2 is an exploded view of FIG. 1 showing only one thread tensioner thereof and omitting the bobbins.

FIG. 2 shows the individual parts of the thread tensioner 3. The details of a thread tensioner can be explained best with reference to FIG. 2.

According to FIG. 2, the thread tensioner 3 includes a drive unit 13, a loading unit 14 and a cup-type thread brake 15. An axis of rotation 16, symbolized in FIG. 2 by a dot-dash line, is aligned horizontally. The drive unit 13 is arranged in the interior of the hollow-section rod 2, as shown particularly in FIG. 3. All drive devices arranged within the hollow-section rod 3 are connected to each other by a common drive element 17. The cup-type thread brake 15 is firmly connected to the support 2 by a releasable clamping element 18 in such a manner that the drive unit 13 also is connected to the cup-type thread brake 15 while preserving a given amount of travel play.

Figure 3:
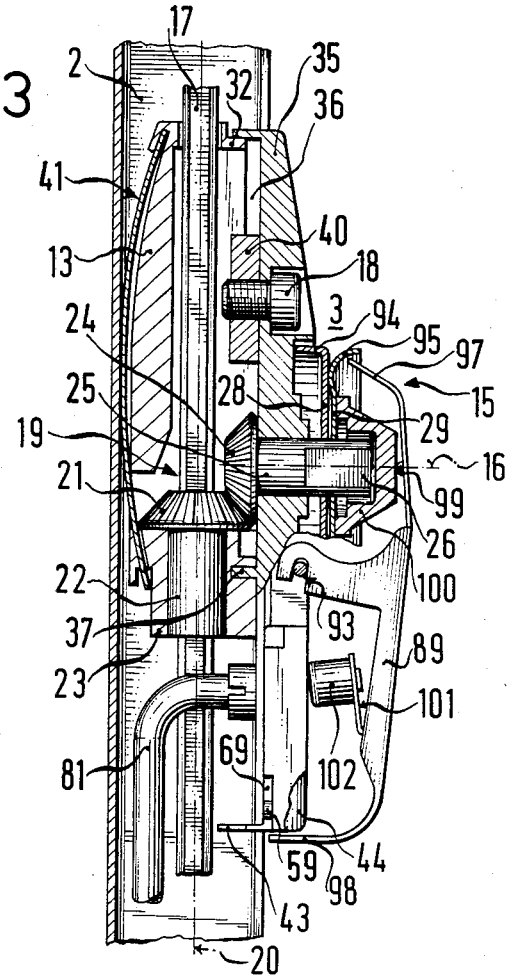
FIG. 3 is a fragmentary longitudinal sectional view of FIG. 1 taken along the line III—III in direction of the arrows.

According to FIG. 3, the drive unit 13 includes a gear transmission 19 having intersecting axes 16 and 20. In the case at hand, miter or bevel gears are involved. The driving gear 21 of the gear transmission 19 has a hollow shaft 22 surrounding the drive element 17, which is supported in the support body 23 of the drive unit 13. The output gear 24 of the gear transmission 19 is connected to a drive shaft 25 of the cup-type thread brake 15. The drive shaft 25 has two flats 26 and 27 which serve for better entrainment of the two cups 28 and 29 of the cup-type thread brake 15.

Figure 4:
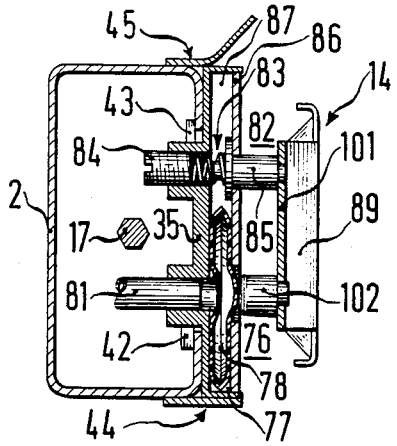
FIG. 4 is a cross-sectional view of FIG. 3 taken along the line IV—IV in direction of the arrows.

The drive element 17 is formed of a rotatable rod driven at one end thereof by an individual drive device 30, the rod 17 having a polygonal cross section, in this case a hexagonal section, which is shown especially in FIG. 4. The individual drive device 30 is connected, according to FIG. 1, to the support 2 and is formed of a small electric gear-reduction motor. The hollow shaft 22 of the drive gear 21 has an inner profile which matches the hexagonal profile of the drive element 17 and ensures a longitudinal shift of the drive element 17 and simultaneous form-locking or positive engagement of the drive gear 21.

The support body 23 of the drive unit 13 has forwardly directed projections 31, 32 and 33 and a depression 34. The cup-type thread brake 15 has a support body 35 with a rearwardly directed depression 36 and a rearwardly directed projection 37. The projections 31, 32 and 33 fit the depression 36 in a form-locking or positive and releasable manner, and the projection 37 fits the depression 34 in a form-locking or positive and releasable manner. Accordingly, the two support bodies 23 and 35 can be plugged together in a form-locking or positive and releaseable manner.

The support body 23 of the drive unit 13 is formed on the forward or front side thereof with two cutouts 38 and 39. Into the cutouts 38 and 39, a holding latch 40 fits which serves for clamping the support body 35 to the support 2. To this end, the releasable clamping element 18 engages the holding latch 40. The holding latch 40 has an internal or nut thread which matches the thread of the clamping element 18 or screw serving as the clamping means. The holding latch 40 makes contact from within with the two edges 9 and 10 of the support 2. In the clamped condition, the holding latch 40 also gives support to or stays the support body 23 of the drive unit 13 in that the cutouts 38 and 39 allow the support body 23 only limited motion.

The support body 23 also has a spring element 41 which is braced against the support 2 so that the support body 23 of the drive unit 13 can easily be moved by hand in the interior of the support 2 for the purpose of assembly, but then remains in the adjusted position in a self-locking manner. The support body 35 clamped to the support 2 by the detachable clamping element 18 rests on the support 2 from the outside. The support body 35 has at one end thereof two feet 42 and 43 which engage behind the edges 9 and 10 defining the longitudinal slot 8 of the support 2. In the assembly, the feet 42 and 43 are inserted into the hollow space of the support 2 through the cutouts 11 and 12. After the clamping, the feet 42 and 43 prevent the support body 35 from flapping out forwardly. The feet 42 and 43, so to speak, save a need for a second clamping element.

Two thread-guiding elements 44 and 45 are connected to the support body 35 by plug connections. According to FIG. 2, the thread-guiding element 44 has a cable friction body 46 of ceramic material and is formed with a guiding edge 47 pointing away from the support body 35 towards the thread brake plane and is provided for guiding the thread for insertion. The thread guiding element 45 likewise has a guiding edge 48 which also serves for guiding the thread during insertion, and points away from the support 2 towards the plane of the thread brake. In addition, the thread-guiding element 45 has a thread eye 49 which can be used selectively for thread-insertion or threading instead of the guiding edge 48. Thus, FIG. 1 shows, for example, that the thread 50 is guided in the thread tensioner 3 along the guiding edge 48, while the thread 51 is drawn towards the thread tensioner 4 through the thread eye 49.

According to FIG. 2, the thread-guiding element 44 has projections 52 and 53 directed toward the support body 35 and also has depressions 64 to 67. The support body 35 has projections 56 to 59 directed toward the guidance element 44 and also has depressions 68 and 69. These projections and depressions mutually engage alternatingly in a form-locking or positive and releasable manner. Also, the thread-guiding element 45 has projections 54 and 55 which are directed towards the support body 35, and also has depressions 70 to 73. The support body 35 has depressions 74 and 75 and projections 60 to 63 matching with the corresponding projections 54 and 55 and depressions 70 to 73 and directed towards the thread-guiding element 45. The projections and depressions of the support body 35 engage the projections and depressions of the thread-guiding elements alternatingly in a form-fitting or positive and releasable manner. A part of the thread-guiding element 44, provided with the projections 52 and 53 and the depressions 64 and 67, is located between the support body 35 and the support 2. In the same manner, a part of the thread-guiding element 45 provided with the projections 54 and 55 and the depressions 70 and 73 is located between the support body 35 and the support 2. Both thread-guiding elements 44 and 45 are secured in position thereof by clamping of the support body 35. Before the support body 35 is clamped, the thread-guiding elements can be buttoned by hand to the support body or unbuttoned from the support body; after the support body is clamped against the support, this is no longer possible.

The loading unit 14, shown in particular also in FIG. 4, has a pneumatic loading device 76 for loading the outer cup 29. The pneumatic loading device 76 is disposed in the support body 35. It includes a chamber 77, in which an elastic container 78 of variable volume connected to a central compressed-gas supply device is located. The container 78 acts on mechanical transmission means which cause the loading of the cup 29. The chamber 77 is arranged in the support body 35 as shown particularly in FIG. 4.

Figure 5:
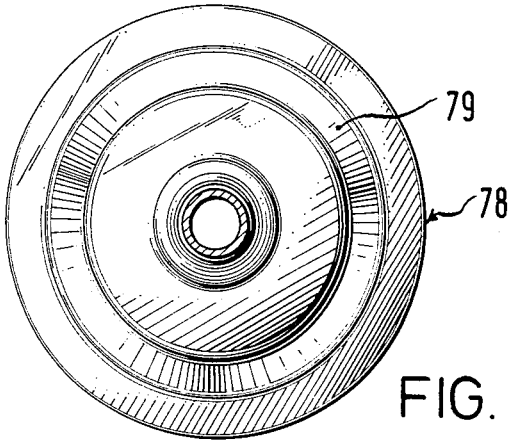
FIGS. 5 and 6 are plan and side views, respectively, of an elastic container forming part of the assembly.
Figure 6:
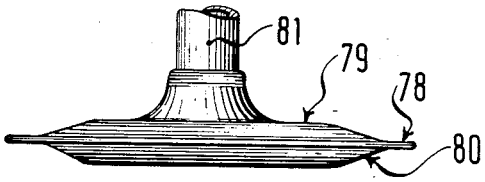

According to FIGS. 5 and 6, the elastic container 78 is formed of plastic foils 79 and 80, the edges of which are welded together. A flexible plastic hose 81 terminating in the interior of the elastic container 78 is welded to the container 78. The plastic hose 81 has at one end thereof a disc-like enlargement which is connected to the elastic container 78 on the inside of the container 78.

The hereinaforementioned mechanical transmission means is discussed somewhat later herein because the loading unit 14 has, besides the pneumatic loading device 76, also an adjustable mechanical loading device 82 which cooperates with the pneumatic loading device 76. In the illustrated embodiment, the applied direction of the force of the pneumatic loading device 76 is the same as that of the force of the mechanical loading device 82. The mechanical loading device 82 has a spring 83, the spring force of which can be adjusted by an adjusting screw 84. The spring 83 acts on a plunger 85 which protrudes to the outside through a disassemblable lid 86. The lid 86 closes off a further chamber which receives therein the mechanical loading device 82 and is connected with the hereinaforementioned chamber 77. Both chambers 77 and 87 are jointly closed off by the lid 86. The lid 86 has two openings, one for the plunger 85 and a second opening 88 for transmitting the force from the elastic container 78 to a loading element 89 which belongs to the aforementioned mechanical transmission means. The loading element 89 is constructed as a lever, as shown in particular in FIG. 2, and is in contact with the outer cup 29 of the cup-type thread brake 15. More specifically, the loading element 89 is formed of a two-arm lever which is pivotally mounted on the support body 35. The swivel or pivot joint of the loading element 89 is formed of two hinges 90 and 91 which can be hung and removed. The hinges 90 and 91 can be hung in pins 92 and 93 which are provided at the sides of the support body 35.

Measures have been taken to facilitate the threading or insertion operation. To this end, for example, the support body 35 is bevelled towards the top and towards the support 2. The rear cup 28 has a dish-shaped rim 94 which extends into a depression 96 formed in the support body 35 of the cup-type thread brake 15. This not only improves the threading, but because of this measure, the cups can be arranged so close to the support 2 that the thread is led past the support in the immediate proximity thereof. The material and the space required for the creel are reduced thereby.

Also, the loading element 89 is bent at its end towards the support 2 for diverting the thread when it is threaded-in. This is to prevent, primarily, a thread to be pulled-in from getting hooked behind the loading element 89. This measure is further aided by the provisions that the outer cup 29 also has a dish-shaped rim 95, behind which one bent-away end 97 of the loading element 89 dips into the cup 29. The other bent-away end 98 of the loading element 89 extends around the lower edge of the support body 35 of the cup-type thread brake for the purpose of securing it in its position with play. Secondly, the bent-away end 98 also serves for diverting the thread or as a threading or insertion aid.

According to FIGS. 3 and 4, the loading element 89 has in the lower part thereof an extension 101, against which, on the one side, the plunger 85 of the mechanical loading device 92 rests and, on the other side, the extension 101 carries a plunger 102, which bears against the elastic container 78. Also, if the elastic container 78 is without pressure, the loading element 89 is continuously tilted towards the loading hood 100 under the action of the mechanical loading device 82.

FIG. 2 shows clearly that all parts of the thread tensioner can be plugged together by hand without the aid of a tool, and be combined with the support 2. Only the clamping of the thread tensioner to the support 2 is accomplished with the aid of a simple screwdriver. If the thread tensioner is to be shifted along the support 2, it is sufficient every time to loosen the clamping element 18 somewhat by means of the screw driver, to push the thread tensioner then into the correct position and to retighten the clamping element.

Besides providing space within the support 2 for the support body 23 of the drive unit 13, space is further provided in the interior of the support 2 for power supply lines and/or control lines. Among the power supply lines there are included, for example, compressed-air supply lines of the pneumatic devices and the electric power supply lines of the individual drive devices. Among the control lines, for example, are lines which serve for the speed control of the individual drive devices.

As mentioned hereinbefore, the invention is not to be limited to the embodiment shown and described. The transmission 19 can have friction wheels, for example, as an alternative to miter gears. The clamping element 18 could consist of a simple clamping wedge. The material of the individual parts is to be selected on the basis of suitability and price, operating reliability and service life.

Figure 7:
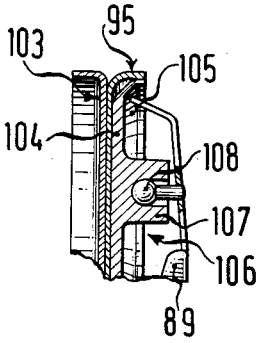
FIG. 7 is a fragmentary view similar to FIG. 3 showing an alternative embodiment of a feature thereof.

The alternative construction according to FIG. 7 offers ease of assembly, besides the advantages of simplicity as well as cost-effective production of the cups, and a further advantage, for example, that the thread can also be guided centrally and radially, respectively, through the cup-type thread brake instead of along a secant. The conditions regarding the stress of the thread are favorable and likewise with respect to wear of the cup-type thread brake.

In the alternative construction according to FIG. 7, the outer cup 29 of the cup-type thread brake 15 is provided with a continuous i.e. unbroken, surface 103 directed towards the adjacent cup. The cup is connected there flexibly to the loading element 89. To this end, an intermediate piece 104 is used which has a centering extension 105 in contact with the rim 95 of the cup 29. This centering extension has the shape of a key.

A snap-in connection 106 is arranged between the cup 29 and the loading element 89. The snap-in connection 106 is formed of a seat 107 attached to the intermediate piece 104 and a ball pin or stud 108 fastened to the loading element 89. The ball-joint like snap-in connection ensures optimum matching of the cups to each other and to the thread.

I claim:

1. Assembly for a bobbin creel comprising a rod-shaped support and thread tensioners connected to the support, said support being a rod with a hollow profile and formed with a longitudinal slot; each of said thread tensioners having a drive unit, a loading unit and at least one cut-type thread break; said cut-type thread brake being formed of a plurality of cups having a substantially horizontal axis of rotation; means for connecting said drive units, respectively, to at least one of the cups of the respective thread brakes for rotating said one cup; said drive units of said thread tensioners being disposed in the interior of said rod with said hollow profile; a common drive element connecting said drive units to one another; said loading unit having means engageable with said thread brake for tensioning a thread extending through the respective thread tensioner; and a releasable clamping element connecting said cup-type thread brake to said support, said drive unit having a support body with forward-directed discontinuities of the surface thereof; said cup-type thread brake having a support body with rearwardly-directed surface discontinuities; said surface discontinuities of said two support bodies engaging one another in a positively locking and releasable manner.

2. Assembly according to claim 1 wherein said releasable clamping element connects said cup-type thread brake also to the respective drive unit.

3. Assembly according to claim 1, wherein said cups of said cup-type thread brake are disposed substantially vertically and so close to said support that a thread is guidable past said support in immediate vicinity of said support.

4. Assembly according to claim 1 wherein said drive unit has a gear transmission with gears having intersecting axes; one of said gears being a driving wheel having a hollow shaft containing said drive element, and the other of said gears being a driven wheel connected to a drive shaft of said cup-type thread brake.

5. Assembly according to claim 1 wherein said drive element is formed of a rotatable rod driven at one of the ends thereof.

6. Assembly accordng to claim 4 wherein said drive element has a polygonal profile, and said hollow shaft of said driving wheel has an inner profile matching said drive-element profile and permitting longitudinal displacement of said drive element and positively locked entrainment of said driving wheel.

7. Assembly according to claim 1 wherein said support formed as a rod with a hollow profile has an angular C-shaped cross section.

8. Assembly according to claim 1 wherein said surface discontinuities are respective projections and depressions, said projections of at least one of said support bodies engaging in said depressions of the other support body.

9. Assembly according to claim 8 wherein said support body of said drive unit is formed with a cutout on a front side thereof, a holding latch for said support body of said cup-type thread brake received in said cutout and engaging two edges of said support from the inside; said support body of said drive unit having a sprng element braced against said support so that said support body is shiftable manually in the interior of said support for assembly purposes, and remains self-lockingly in set position.

10. Assembly according to claim 8 wherein said support body of said cup-type thread brake rests on said support from the outside, is clamped by said releasable clamping element to at least one of said support body of said drive unit and said support and has feet at one end thereof engaging behind said two edges, and wherein said two edges define said longitudinal slot of said support.

11. Assembly according to claim 10 wherein said releasable clamping element engages said holding latch.

12. Assembly according to claim 10 wherein said support has, at least at one of said edges defining said longitudinal slot, at least one cutout for receiving one of said feet of said support body of said cup-type thread brake.

13. Assembly according to claim 1 wherein said support body of said cup-type thread brake has a thread-guiding element on at least one side thereof.

14. Assembly according to claim 13 wherein at least one of said thread-guiding element and said support body of said thread brake has projections, directed towards the other thereof; and at least the other of said thread-guiding element and said support body is formed with depressions; said projections of said at least one of said thread-guiding element and said support body engaging in said depressions of the other thereof in a positive-locking and releasable manner.

15. Assembly according to claim 14 wherein a part of said thread-guiding element formed with a plurality of said projections and depressions, respectively, is disposed between said support body and said support, said thread-guiding element being fixed in position by clamping of said support body.

16. Assembly according to claim 13 wherein said thread-guiding element has at least one guiding edge directed away from said support and towards the plane of said thread brake for the guiding of a thread during threading.

17. Assembly according to claim 1 wherein said thread brake has at least two coaxially aligned cups and said loading unit comprises a pneumatic loading device for at least one of said two cups, said pneumatic loading device being subjectible to a pressure deviating from athmospheric pressure and adjustable centrally for a multiplicity of cup-type thread brakes.

18. Assembly according to claim 17 wherein said pneumatic loading device comprises a chamber wherein an elastic container of variable volume is received, said elastic container being connected to a central compressed-gas supply device, and including mechanical transmission means for loading at least one of said two cups, said mechanical transmission means being acted upon by said elastic container.

19. Assembly according to claim 18 wherein said chamber is located in said support body of said cup-type thread brake.

20. Assembly according to claim 18 wherein said elastic container is formed of foils of plastic material having edges which are welded together, and including a flexible hose of plastic material extending into the interior of said elastic container and adhering to said elastic container.

21. Assembly according to claim 20 wherein said plastic hose has, at the end thereof, a disc-like enlargement connected on the inside to said elastic container.

22. Assembly according to claim 17 wherein said loading unit comprises an adjustable mechanical loading device cooperatively associated with said pneumatic loading device.

23. Assembly according to claim 22 wherein said pneumatic loading device has a force applied in the same direction as the force of said mechanical loading device.

24. Assembly according to claim 22 wherein said pneumatic loading device has a force directed against the force of said mechanical loading device.

25. Assembly according to claim 22 wherein said mechanical loading device comprises a spring having a spring force adjustable by an adjusting screw.

26. Assembly according to claim 22 wherein one of said cups is an inner cup and the other of said cups is an outer cup of said cup-type thread brake, and said loading device is in contact with the outer cup of said cup-type thread brake through the intermediary of a lever-like loading element.

27. Assembly according to claim 26 wherein said pneumatic loading device is formed with a chamber closed off at the front by a detachable lid wherein openings are formed for affording contact between said loading device and said loading element.

28. Assembly according to claim 27 wherein a further chamber wherein said mechanical loading device is received, is also closed off at the front by said lid.

29. Assembly according to claim 26 wherein said cup-type thread brake has an outer cup connected flexibly to said loading element.

30. Assembly according to claim 29, wherein said outer cup has a rim, and including an intermediate member flexibly connected to said loading element having at least one centering extension in contact with said rim of said outer cup.

31. Assembly according to claim 29 including a snap-in connection disposed between said outer cup and said loading element.

32. Assembly for a bobbin creel comprising a rod-shaped support and thread tensioners connected to the support, said support being a rod with a hollow profile and formed with a longitudinal slot; each of said thread tensioners having a drive unit, a loading unit and at least one cut-type thread break; said cut-type thread brake being formed of a plurality of cups having a substantially horizontal axis of rotation; means for connecting said drive units, respectively, to at least one of the cups of the respective thread brakes for rotating said one cup; said drive units of said thread tensioners being disposed in the interior of said rod with said hollow profile; a common drive element connecting said drive units to one another; said loading unit having means engageable with said thread brake for tensioning a thread extending through the respective thread tensioner; and a releasable clamping element connecting said cup-type thread brake to said support, said thread brake having at least two coaxially aligned cups and said loading unit comprising a pneumatic loading device for at least one of said two cups, said pneumatic loading device being subjectible to a pressure deviating from atmospheric pressure and adjustable centrally for a multiplicity of cup-type thread brakes, said loading unit comprising an adjustable mechanical loading device cooperatively associated with said pneumatic loading device, one of said cups being an inner cup and the other of said cups being an outer cup of said cup-type thread brake, and said loading device being in contact with the outer cup of said cup-type thread brake through the intermediary of a lever-like loading element, said loading element comprising a two-arm lever pivotally mounted on said support body of said cup-type thread brake.

33. Assembly according to claim 32 wherein the pivot of said loading element is formed of at least one suspendible and removable hinge.

34. Assembly for a bobbin creel comprising a rod-shaped support and thread tensioners connected to the support, said support being a rod with a hollow profile and formed with a longitudinal slot; each of said thread tensioners having a drive unit, a loading unit and at least one cut-type thread break; said cut-type thread brake being formed of a plurality of cups having a substantially horizontal axis of rotation; means for connecting said drive units, respectively, to at least one of the cups of the respective thread brakes for rotating said one cup; said drive units of said thread tensioners being disposed in the interior of said rod with said hollow profile; a common drive element connecting said drive units to one another; said loading unit having means engageable with said thread brake for tensioning a thread extending through the respective thread tensioner; and a releasable clamping element connecting said cup-type thread brake to said support, said thread brake having at least two coaxially aligned cups and said loading unit comprising a pneumatic loading device for at least one of said two cups, said pneumatic loading device being subjectible to a pressure deviating from atmospheric pressure and adjustable centrally for a multiplicity of cup-type thread brakes, said loading unt comprising an adjustable mechanical loading device cooperatively associated with said pneumatic loading device, one of said cups being an inner cup and the other of said cups being an outer cup of said cup-type thread brake, and said loading device being in contact with the outer cup of said cup-type thread brake through the intermediary of a lever-like loading element, an exchangeable load hood being disposed between one of said cups and said loading element for optimal force distribution.

35. Assembly according to claim 1 wherein space for receiving power supply lines and control lines, respectively, is provided in the interior of said support adjacent said support body of said drive unit.

36. Assembly according to claim 1 wherein said support is connected to an individual driving device for said drive element of said drive units.

37. Assembly according to claim 36 wherein said individual driving device comprises an electric reduction-gear motor.

38. Assembly according to claim 36 wherein said driving device is a stepping motor.

39. Assembly according to claim 1 wherein said cup-type thread brake has a rear cup with a dish-shaped rim extending into a depression formed in said support body of said cup-type thread brake; and said support body of said cup-type thread brake is tapered towards said support for guiding a thread during threading.

40. Assembly for a bobbin creel comprising a rod-shaped support and thread tensioners connected to the support, said support being a rod with a hollow profile and formed with a longitudinal slot; each of said thread tensioners having a drive unit, a loading unit and at least one cut-type thread break; said cut-type thread brake being formed of a plurality of cups having a substantially horizontal axis of rotation; means for connecting said drive units, respectively, to at least one of the cups of the respective thread brakes for rotating said one cup; said drive units of said thread tensioners being disposed in the interior of said rod with said hollow profile; a common drive element connecting said drive units to one another; said loading unit having means engageable with said thread brake for tensioning a thread extending through the respective thread tensioner; and a releasable clamping element connecting said cup-type thread brake to said support, said thread brake having at least two coaxially aligned cups and said loading unit comprising a pneumatic loading device for at least one of said two cups, said pneumatic loading device being subjectible to a pressure deviating from atmospheric pressure and adjustable centrally for a multiplicity of cup-type thread brakes, said loading unit comprising an adjustable mechanical loading device cooperatively associated with said pneumatic loading device, one of said cups being an inner cup and the other of said cups being an outer cup of said cup-type thread brake, and said loading device being in contact with the outer cup of said cup-type thread brake through the intermediary of a lever-like loading element, said loading element being bent away towards said support at the ends thereof for diverting the thread during threading.

41. Assembly according to claim 40 wherein said outer cup of said cup-type thread brake has a dish-shaped rim behind which one bent-away end of said loading element dips into said cup, while the other bent-away end of said loading element extends around said rim of said support body of said cup-type thread brake for position-fixing with play.

42. Assembly according to claim 1 wherein said cup-type thread brake has an outer cup having a continuous surface facing an adjacent cup of said cup-type thread brake.

* * * * *